US005869911A

United States Patent [19]

Tanaka

[11] Patent Number: 5,869,911

[45] Date of Patent: Feb. 9, 1999

[54] METHOD AND APPARATUS FOR ACCELERATING FLYING BODIES

[75] Inventor: Koichi Tanaka, Nishikasugai-gun, Japan

[73] Assignees: Koichi Tanaka; Morita and Company Co., Ltd., both of Aichi, Japan

[21] Appl. No.: 878,318

[22] Filed: Jun. 18, 1997

Related U.S. Application Data

[63] Continuation-in-part of Ser. No. 368,882, Jan. 5, 1995, abandoned.

[30] Foreign Application Priority Data

Jan. 31, 1994 [JP] Japan ..... 6-028904

[51] Int. Cl.[6] ..... H02K 1/00

[52] U.S. Cl. ..... 310/12; 89/8; 124/3

[58] Field of Search ..... 89/8; 124/3, 54, 124/60, 63, 56, 61, 58; 376/125; 73/12.01, 12.04, 12.05; 72/56; 102/476, 501; 310/12

[56] References Cited

U.S. PATENT DOCUMENTS

| | | | |
|---|---|---|---|
| 3,646,791 | 3/1972 | Leftheris | 72/56 |
| 4,121,123 | 10/1978 | Crolius | 310/10 |
| 4,349,200 | 9/1982 | Wakefield | 273/371 |
| 4,656,918 | 4/1987 | Rose et al. | 89/8 |
| 4,753,153 | 6/1988 | Jasper | 89/8 |
| 4,760,769 | 8/1988 | Jasper, Jr. | 89/8 |
| 5,173,568 | 12/1992 | Parmer | 89/8 |
| 5,435,225 | 7/1995 | Shahinpoor | 89/8 |
| 5,442,846 | 8/1995 | Snaper | 29/419.2 |
| 5,483,863 | 1/1996 | Dreizin | 89/8 |

FOREIGN PATENT DOCUMENTS

| | | | |
|---|---|---|---|
| 1-214252 | 8/1989 | Japan | H02K 41/00 |

*Primary Examiner*—Nestor Ramirez
*Assistant Examiner*—B. Mullins
*Attorney, Agent, or Firm*—Koda & Androlia

[57] ABSTRACT

Disclosed is a method and an apparatus for accelerating and shooting a flying body at superhigh speed, consisting of a capacitor in which a high electric charge can be stored; a primary coil connected to the capacitor via a switching means; a conductive cylindrical liner disposed in the primary coil; an opening defined on a cylindrical wall of the cylindrical liner; and a flying body interposed in the opening and assuming electrical continuity with the liner; wherein a high electric charge stored in the capacitor is momentarily applied to the primary coil so as to compress abruptly the cylindrical liner radially inward and to shoot the flying body interposed in the opening toward the axis of the liner.

6 Claims, 4 Drawing Sheets

METHOD AND APPARATUS FOR ACCELERATING FLYING BODIES

This application is a continuation-in-part, of application No. 08 /368,882, filed 01/05/1995, now abandoned.

BACKGROUND OF THE INVENTION

This invention relates to a method of electromagnetically accelerating flying bodies which can shoot flying bodies at a superhigh speed and which can be implemented at a low running cost without requiring any gigantic equipment.

For example, rockets and artificial satellites which travel outer space are constantly exposed to the danger of bumping against meteorites and dusts flying at very high speeds (e.g. 50 km/sec) through the space. Thus, in order to simulate the bumping of a rocket against such high-speed flying matters on the ground so as to test how the rocket might be damaged, bump tests, in which high-speed flying bodies are allowed to impinge upon an object to be tested, are carried out. Impact tests using high-speed flying bodies are also carried out frequently in developing new materials so as to test their physical properties. Meanwhile, examples of apparatus for accelerating and shooting flying bodies at a high speed against the object to be tested are, for example, a high-pressure gas gun which shoots various types of solid flying bodies from a barrel-like pipe thereof by releasing at once the compressed of a high-pressure gas, a powder gun, as well as, a rail gun and a plasma gun which resort to the principle of electromagnetic acceleration.

However, the speed of the flying body shot by such high-pressure gas gun, which may depend on the degree of compression of the high-pressure gas employed, is far from those of the high-speed flying matters which are possible to bump against vessels such as rockets traveling through outer space (e.g. 50 km/sec) or those of the high-speed flying bodies required for testing the physical properties of new materials (e.g. 10 km/sec). Accordingly, the high-pressure gas gun is not employable for the simulation tests on the ground. As the apparatus which can shoot flying bodies at much higher speeds than by the high-pressure gas gun, the above-described powder gun, rail gun, plasma gun, etc. are known. It is possible to shoot flying bodies at a high speed of about 10 km/sec using these guns based on the principle of electromagnetic acceleration, but such speed is far from reaching the superhigh speed of meteorites, dusts, etc. flying through outer space (e.g. 50 km/sec). Further, the rail gun and plasma gun involve problems in that they require long rails, and thus the scale of the equipment is enlarged, and that the rails are fused by sparks to be unusable each time the guns are used, leading to extremely increased running cost.

This invention is proposed in view of many problems inherent in the prior art means for accelerating high-speed flying bodies and in order to solve them suitably. It is an objective of the invention to provide a method of accelerating flying bodies which enables shooting flying bodies at a speed comparable to the level attainable by the rail gun, and which can be implemented at a low running cost without requiring any gigantic equipment, as well as, an apparatus therefor.

SUMMARY OF THE INVENTION

As a means for generating a superhigh magnetic field, a magnetic flux compression method called Cnare's method is known, and the present invention utilizes the Maxwell stress to be generated concomitantly with this electromagnetic flux compression. Therefore, the electromagnetic flux compression method will be described first of all. FIG. 7 shows an apparatus developed for generating a strong magnetic field (S. Chikakado et al. "KAGAKU (Science)" February number, pp. 74–77, published by Iwanami Shoten, Publishers (1977)). This apparatus essentially consists of a capacitor 10 which can store extremely high electric charge, a primary coil 14 connected to the capacitor 10 via a switching element 12, and a conductive cylindrical liner 16 disposed coaxially in the primary coil 14. The capacitor 10 has sufficiently high capacity and storage voltage, and, for example, an enormous electrostatic energy of about 285 KJ can be stored therein. Meanwhile, the inductance of the power circuit consisting of the capacitor 10 and the switching element 12 is set to a very low level of, for example, about 340 nH. Incidentally, the cylindrical liner 16 is made of a conductive metal such as copper and aluminum.

When the switching element 12 is closed to release the electric charge stored in the capacitor 10 at once, a pulsative primary current of about 1 MA flows across the primary coil 14 in a very short while. While no magnetic field intrudes into the inner space of the cylindrical liner 16, in accordance with the Fleming's rule, at the moment that a primary current I flowed across the primary coil 14, a great induced current i flows afterward across the liner 16 in the opposite direction with respect to the primary current I. At this moment a strong magnetic field is generated only in the narrow annular space defined between the primary coil 14 and the liner 16, and the liner 16 is suddenly compressed radially inward and deformed due to the so-called Maxwell stress (the speed of deformation is as high as 1 km/sec). The intensity of the magnetic field is extremely increased, due to abrupt contraction of the volume of the inner space of the liner 16, to provide finally a strong magnetic field. Incidentally, the electrostatic energy, inductance and primary current values are cited from the description in S. Chikakado et al. "KAGAKU (Science)" February number (1977).

This invention utilizes the magnetic flux compression method described above, and the basic principle of the invention is to shoot flying bodies at a superhigh speed resorting to the Maxwell stress induced by the strong magnetic field generated in the space defined between the primary coil and the liner, when a great electric charge is applied momentarily across the primary coil to form a primary current so as to allow an induced current to flow across the cylindrical liner (or an equivalence).

Namely, in order to solve the above-described problems and attain the intended objects suitably, the method of accelerating a flying body according to one aspect of this invention comprises applying momentarily a high pressure electric charge stored in a capacitor to a primary coil to flow a pulsative primary current so as to form an induced current across a conductive cylindrical liner, disposed in the primary coil, in the direction opposite to that of the primary current; and compressing abruptly the cylindrical liner radially inward so as to shoot a flying body, interposed in a severed portion of a cylindrical wall of the liner and assuming electrical continuity therewith, toward an axis of the liner based on electromagnetic acceleration.

The method of accelerating a flying body according to another aspect of the invention comprises applying momentarily a high electric charge stored in a capacitor to a primary coil to flow a pulsative primary current so as to form an induced current across a conductive cylindrical airtight container, disposed in the primary coil, in the direction opposite to that of the primary current; and compressing abruptly the airtight container radially inward so as to shoot outward a flying body loaded in a predetermined position of the airtight container with the aid of the compressive force of a gas charged in the airtight container.

In order to suitably implement the method of accelerating a flying body, the apparatus for accelerating a flying body according to another aspect of the invention comprises a capacitor in which a high electric charge can be stored; a primary coil connected to the capacitor via a switching means; a conductive cylindrical liner disposed in the primary coil; an opening defined on a cylindrical wall of the cylindrical liner by severing fully the liner; and a flying body interposed in the opening and assuming electrical continuity with the liner; wherein a high-pressure electric charge stored in the capacitor is momentarily applied to the primary coil so as to compress abruptly the cylindrical liner radially inward and to shoot the flying body interposed in the opening toward the axis of the liner.

Meanwhile, the apparatus for accelerating a flying body according to another aspect of the invention comprises a capacitor in which a high electric charge can be stored; a primary coil connected to the capacitor via a switching means; an airtight container disposed in the primary coil; an opening defined at a predetermined portion of the airtight container; and a flying body loaded in the airtight container; wherein a high electric charge stored in the capacitor is momentarily applied to the primary coil so as to compress abruptly the airtight container radially inward and to shoot outward the flying body loaded in the opening of the airtight container.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

PREFERRED EMBODIMENT OF THE INVENTION

Figure 7:
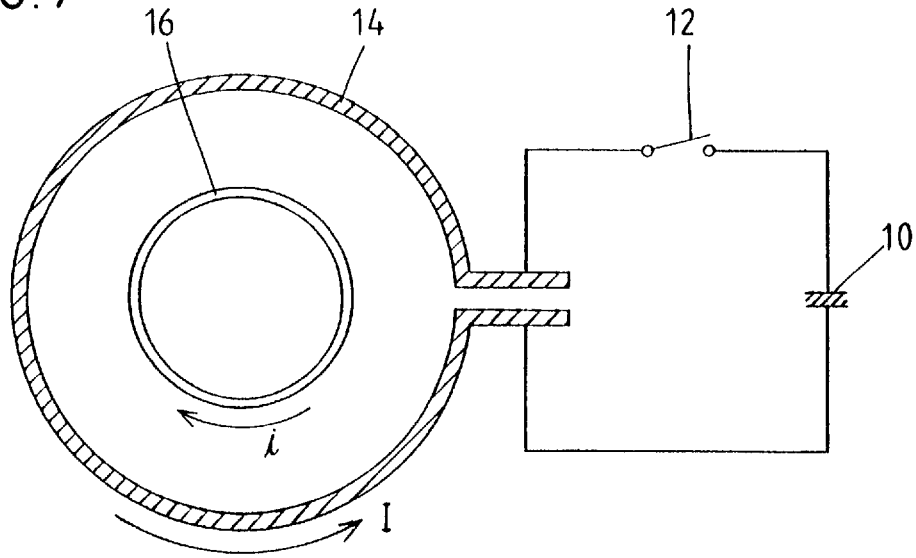
FIG. 7 is a schematic view of an apparatus for implementing the magnetic flux compression method.
Figure 1:
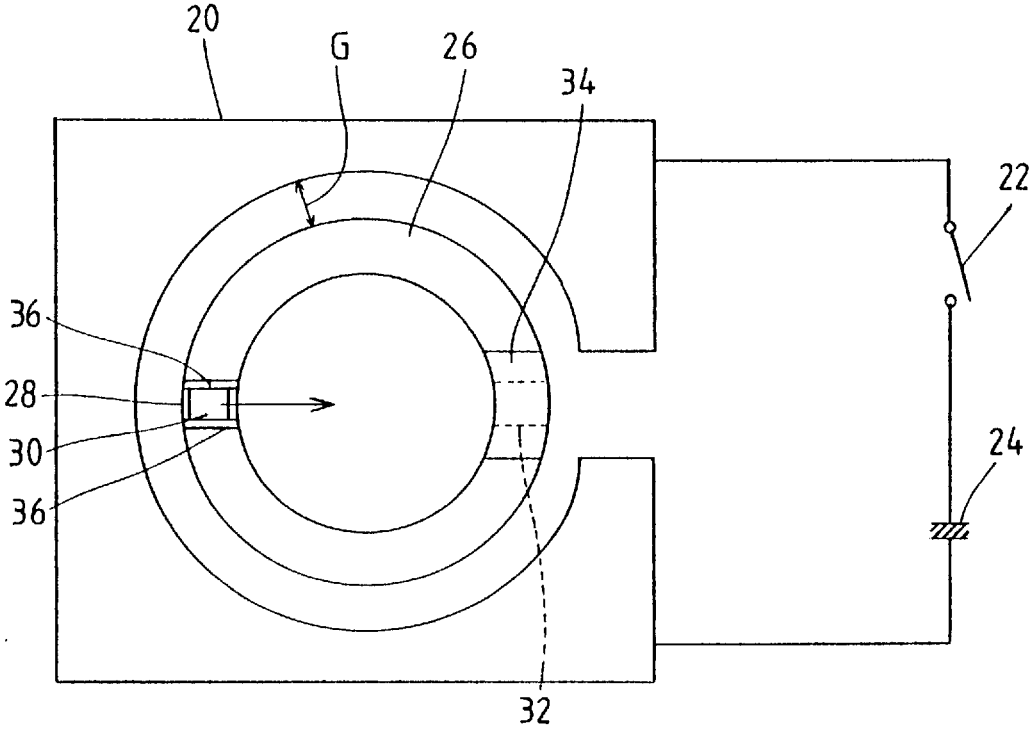
FIG. 1 is a plan view showing schematically an embodiment of the apparatus for accelerating flying bodies according to a first aspect of the invention.

The method and apparatus for accelerating flying bodies according to this invention will be described below by way of preferred embodiments with reference to the attached drawings. FIG. 1 is a plan view showing schematically an embodiment of the apparatus for accelerating flying bodies according to a first aspect of the invention, in which a primary coil 20 is of a rigid and solid structure made of a conductive metal such as steel with a single winding or a winding of 2 or 3 turns applied. To both open ends of the primary coil 20 are connected a power circuit consisting of a switching element 22 typified by ignitron and a capacitor 24. The capacitor 24 is adapted to be charged with a high electrostatic energy of, for example, about 285 KJ. A cylindrical liner 26 is disposed in the circular hollow core space of the primary coil 20 coaxially therewith, and a predetermined annular space G is formed between these two members 20,26.

Figure 3:
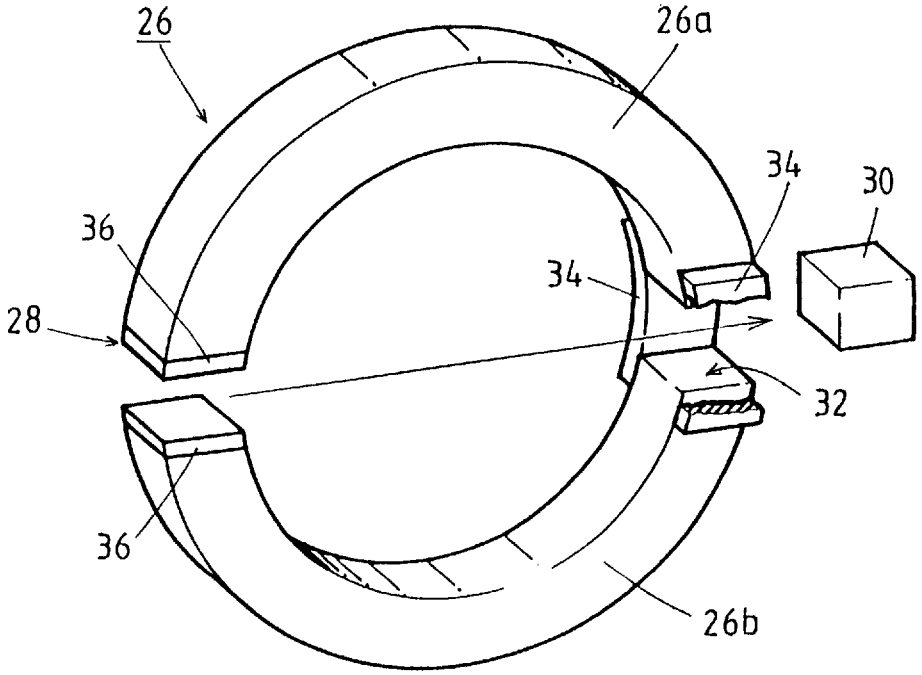
FIG. 3 is a schematic exploded perspective view of the cylindrical liner to be employed in the apparatus for accelerating flying bodies of the embodiment according to the first aspect of the invention, with a primary coil being omitted; in which the flying body is being shot from the apparatus.
Figure 4:
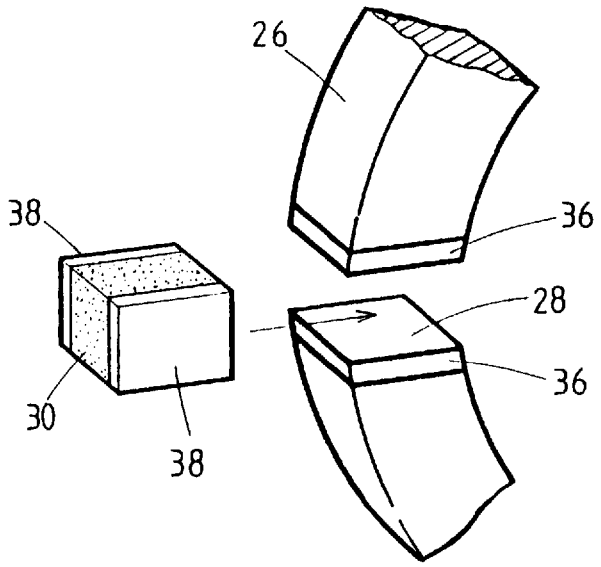
FIG. 4 is a partially cut-away perspective view of a flying body provided with conductive armatures on both sides thereof, provided that the flying body is made of an electrically insulating material or a metal having poor conductivity.

The cylindrical liner 26 is, for example, made of a conductive metal such as copper and aluminum, and a first opening 28 having a predetermined aperture is defined so as to fully sever the cylindrical wall of the liner 26 radially. A flying body 30 is to be intimately loaded in this first opening 28, as will be described later. A second opening 32 having a predetermined aperture is also formed on the cylindrical wall at a position opposing to the first opening 28 thereof via the cylinder axis. Namely, the cylindrical liner 26 basically consists of two separate pieces of arcuate segments 26*a*,26*b*, and the portions of the lateral surfaces of these two segments 26*a*,26*b* where the second opening 32 is formed are connected by welding thereto a pair of connecting plates 34 having good conductivity so as to secure mechanical and electrical continuity between these two segments 26*a*,26*b*. Incidentally, it can happen that the first opening 28 is fused by the sparks generated when the flying body 30 loaded therein is shot at a high speed under electromagnetic acceleration to such a degree as cannot be used again. Accordingly, as shown in FIG. 3, it is recommended to provide removably a pair of shoes 36 made of a metal having good conductivity at each open end of the arcuate segments 26*a*,26*b* defining this first opening 28. These shoes 36 are to be replaced with new ones every time they are fused by shooting the flying body 30.

Since the flying body 30 is usually made of a conductive metal, an electrically closed loop is formed along the cylindrical wall of the liner 26 by loading the flying body 30 into the first opening 28 of the cylindrical liner 26. However, the flying body 30 is sometimes required to be made of an electrically insulating material or a metal having poor conductivity depending on the physical properties and other essential properties of the target object to be tested. In such cases, for example, it is proposed to apply a pair of armatures 38 made of a conductive material on each lateral surface of the flying body 30 so as to close the first opening 28 of the cylindrical liner 28 with these armatures 38 to secure electrical continuity between the arcuate segments 26*a*,26*b*. In other words, when the flying body 30 is made of an insulating material, the cylindrical liner 26 assumes electrically an open loop, even if the flying body 30 is loaded in the first opening 28. However, the presence of the armatures 38 in the first opening 28 results in a closed loop.

Figure 2:
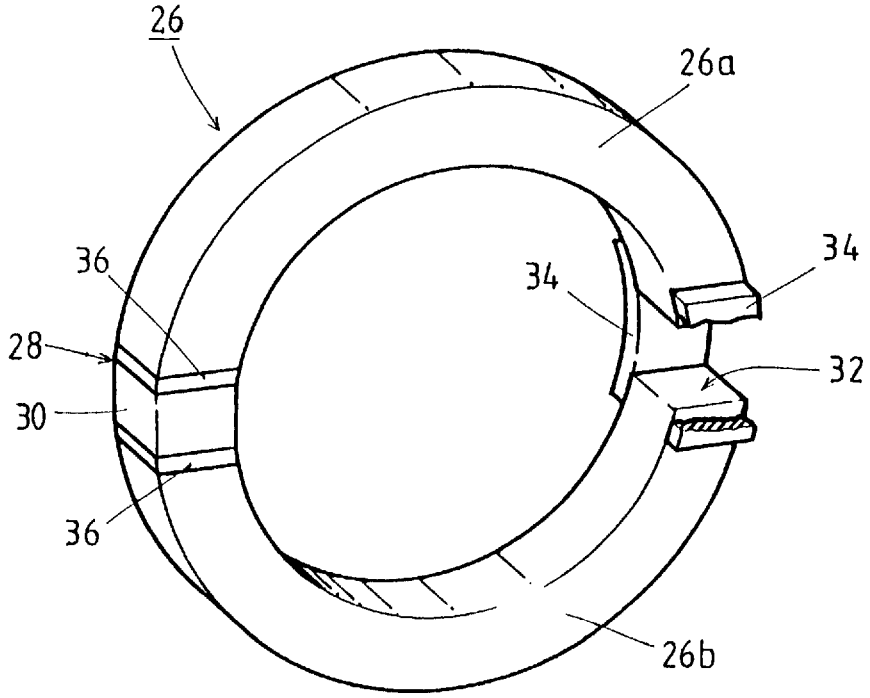
FIG. 2 is a schematic perspective view of a cylindrical liner to be employed in the apparatus for accelerating flying bodies of the embodiment according to the first aspect of the invention with a primary coil being omitted; in which a flying body is intimately loaded in a first opening of the cylindrical liner.

Next, action of the apparatus for accelerating flying bodies according to this constitution will be described. It should be appreciated that the flying body 30 is intimately loaded in the first opening 28 of the cylindrical liner 26, as shown in FIG. 2, to form an electrically closed loop along the liner 26. If the switching element 22 shown in FIG. 1 is closed (turned on) in this state, the great electric charge charged in the capacitor 24 is applied at once to the primary coil 20 in a very short while. Then, a pulsative primary current of about 1 MA flows across the primary coil 20 to generate an induced current which flows across the cylindrical liner 26 in the direction opposite to that of the primary current, so that the liner 26 is abruptly compressed radially inward due to the so-called Maxwell stress. Accordingly, the flying body 30 loaded in the first opening 28 is shot inward in the radial direction of the liner 26 as it undergoes deformation under compression, as shown in FIG. 3. The speed that the cylindrical liner 26 deforms due to the Maxwell stress as described above is extremely great, so that the speed that the flying body 30 is shot is superhigh which greatly exceeds the speed of a flying body shot by a conventional gas gun.

Still further, each one of the arcuate segments 26*a* and 26*b* of the cylindrical liner 26 has on its inner side a first guide piece 50 and 52, respectively. The first guide pieces 50 and 52 are made from insulating material and formed in a semicircular disc shape, and a passage 54 is defined between the first guide piece 50 and the second guide piece 52 so that the flying body 30 released from the first opening 28 is guided by the passage 54 so as to advance toward the second opening 32. Furthermore, disk-shaped second guide pieces 56 and 58, made from an insulating material, are provided on both sides of the cylindrical liner 26. The second guide pieces 56 and 58 are positioned on both sides of the cylindrical liner 26 with regard to the axis of the liner 26, thus covering the interior of the cylindrical liner 26. The second guide pieces 56 and 58 are positioned and fixed by a combination of a plurality of bolts 60 and nuts 62 so as to hold the first guide pieces 50 and 52 in between.

With this structure, the flying body 30 released from the first opening 28 is reliably guided toward the second opening 32. In this case, any movement of the flying body 30 in the radial direction which crosses the direction of advancement of the flying body 30 is restrained by the first guide pieces 50 and 52. Similarly, any movement of the flying body 30 in the axial direction of the cylindrical liner 26 is restrained by the second guide pieces 56 and 58.

Also, each one of the first guide pieces 50 and 52 and each one of the second guide pieces 56 and 58 is designed so as to allow the cylindrical liner 26 to be compressed in the radial direction thereof by way of the so-called Maxwell stress.

Incidentally, since the flying body 30 released from the first opening 28 is shot outward through the second opening 32 of the cylindrical liner 26, the object to be subjected to a breakdown test or physical property tests may be disposed as a target in the shooting direction. While one flying body 30 is adapted to be shot in the illustrated embodiment, the cylindrical liner 26 may be adapted to be able to load thereon a plurality of flying bodies 30 along the periphery thereof so as to shoot the flying bodies 30 in multiple directions. Further, physical property tests may be carried out by loading on the cylindrical liner 26 two flying bodies 30 on each side of the axis of the cylinder to oppose to each other and shooting them at the same time so that they may bump against each other at the central position of the cylinder. In this case, the speed that these two flying bodies 30 bump against each other is doubled, enabling superhigh-speed tests.

Figure 5:
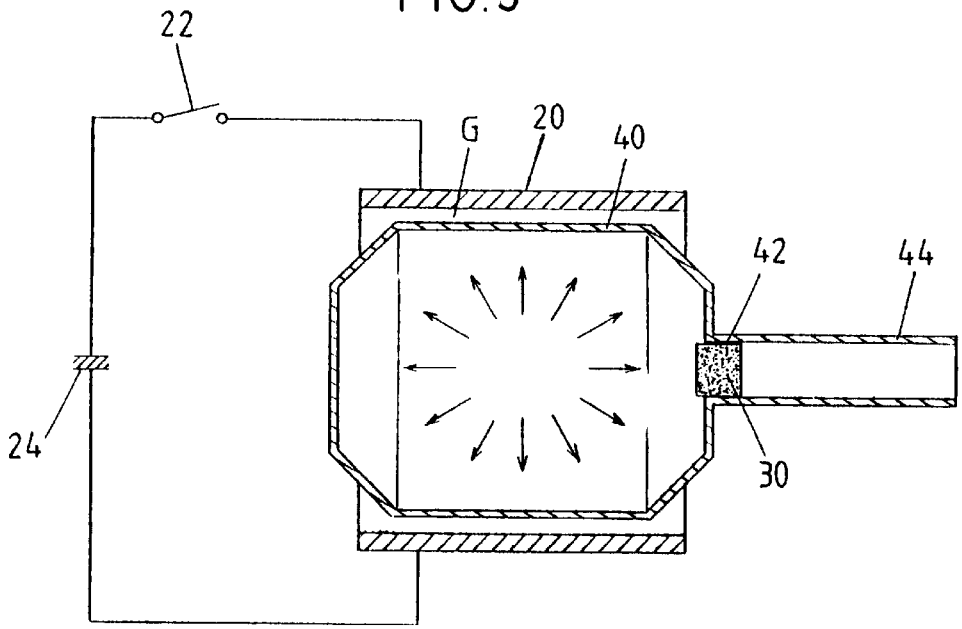
FIG. 5 is a schematic vertical cross-sectional side view of an apparatus for implementing a method of accelerating flying bodies according to a second aspect of the invention, with a flying body being loaded therein.
Figure 6:
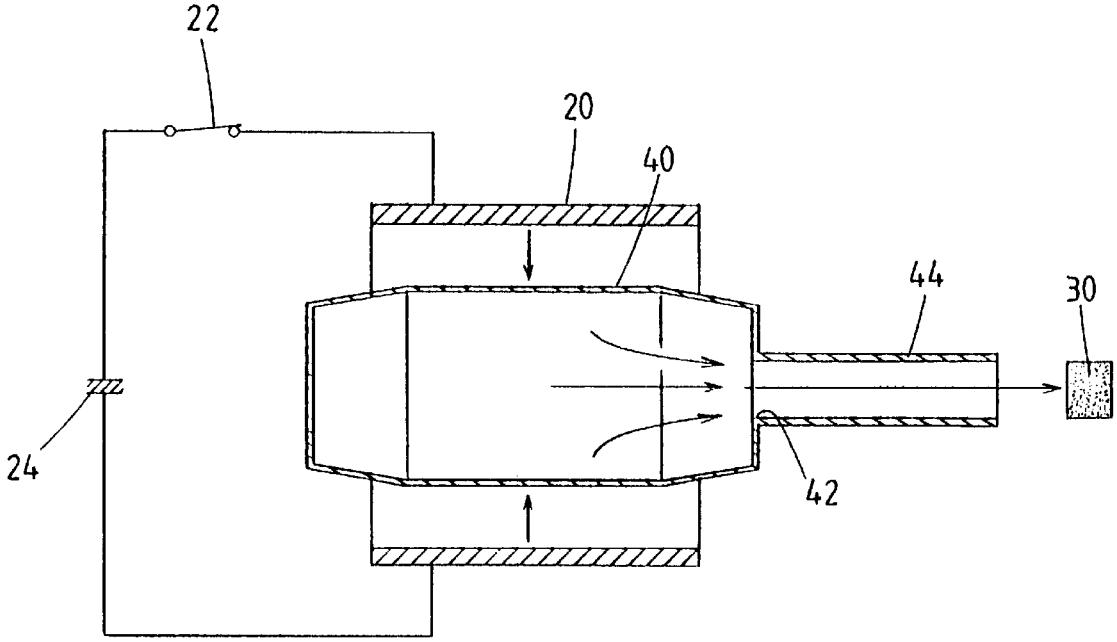
FIG. 6 is a schematic vertical cross-sectional side view of an apparatus for implementing a method of accelerating flying bodies according to a second aspect of the invention, in which the flying body is being shot from the apparatus with the aid of gas pressure.

FIGS. 5 and 6 show schematically an apparatus in which the method of accelerating flying bodies according to a second aspect of the invention is implemented. In this accelerating apparatus, the constitution of the power circuit consisting of a switching element 22 and a capacitor 24 and that of a primary coil 20 are the same as the embodiment of FIG. 1. However, a cylindrical airtight container 40 made of a metal having good conductivity is disposed in the primary coil 20 coaxially therewith, and an annular space G having a predetermined clearance is formed between the inner wall surface of the coil 20 defining the hollow core space and the outer wall surface of the airtight container 40. The airtight container 40 constitutes, for example, a pressure vessel in which a high-pressure gas is to be charged, and a flying body 30 is adapted to be intimately loaded in an opening 42 defined at one end of the container 40. Incidentally, a pipe 44 extending in alignment with the axis of the airtight container 40 to the outside of the container 40 is preferably connected to the opening 42 so as to guide the shooting direction of the flying body 30 by the pipe 44 when the flying body 30 is shot, as will be described later.

Next, action of the apparatus for accelerating flying bodies according to this constitution will be described. As described already referring to FIG. 2, a great electric charge which has been previously charged in the capacitor 24 is applied at once to the primary coil 20 in a very short while by closing the switching element 22. Then, a pulsative primary current of about 1 MA flows across the primary coil 20 to generate an induced current which flows across the airtight container 40 in the direction opposite to that of the primary current, so that the airtight container 40 is abruptly compressed radially inward due to the so-called Maxwell stress. Accordingly, the flying body 30 loaded in the opening 42 can be shot out of the container 40 at an extremely high speed with the aid of the gas pressure of a high-pressure gas charged in the airtight container 40, as shown in FIG. 6. In this case, the gas to be charged in the airtight container 40 may not necessarily be of high pressure, and it may be of normal pressure depending on the application.

In view of the aspect that the method and apparatus for accelerating flying bodies can shoot flying bodies at a superhigh speed, there are proposed an application to bumping tests of superhigh-speed flying bodies to be carried out against rockets and artificial satellites which were unachievable by means of the conventional gas guns and the like due to their insufficient shooting speed, an application of high-speed shooting of deuterium ice pellets into a plasma space in a fusion reactor and other applications.

It should be apparent to those skilled in the art that the present invention may be embodied in many other specific forms without departing from the spirit or scope of the invention. Therefore, the present embodiments are to be considered as illustrative and not restrictive, and the invention is not to be limited to the details given herein, but may be modified within the scope of appended claims.

What is claimed is:

1. A method of accelerating a flying body which comprises:

applying momentarily a high electric charge stored in a capacitor to a primary coil to flow a pulsative primary current so as to form an induced current across a conductive cylindrical liner, disposed in said primary coil, in the direction opposite to that of said primary current; and compressing abruptly said cylindrical liner radially inward so as to shoot a flying body, interposed in a severed portion of a cylindrical wall of said liner and assuming electrical continuity therewith, toward an axis of said liner based on radial compression of the cylindrical liner due to Maxwell stress.

2. A method of accelerating a flying body which comprises:

applying momentarily a high electric charge stored in a capacitor to a primary coil to flow a pulsative primary current so as to form an induced current across a conductive cylindrical airtight container, disposed in said primary coil, in the direction opposite to that of said primary current; and compressing abruptly said airtight container radially inward so as to shoot outward a flying body loaded in a predetermined position of said airtight container with the aid of the compressive force of a gas compressed in said airtight container.

3. An apparatus for accelerating a flying body, which comprises:

a capacitor in which a high electric charge is stored;

a primary coil connected to said capacitor via a switching means;

a conductive cylindrical liner disposed in said primary coil;

an opening provided in a cylindrical wall of said cylindrical liner, said opening formed by cutting out a portion of said cylindrical liner; and a flying body interposed in said opening and assuming electrical continuity with said liner;

wherein a high electric charge stored in said capacitor is momentarily applied to said primary coil so as to compress abruptly said cylindrical liner radially inward and to shoot said flying body interposed in said opening toward the axis of said liner.

4. The accelerating apparatus according to claim 3, wherein an armature made of a conductive material is applied to said flying body, provided that said flying body is made of an electrically insulating material so as to recover electrical continuity of said cylindrical liner at said opening.

5. An apparatus for accelerating a flying body, which comprises:

a capacitor in which a high electric charge is stored;

a primary coil connected to said capacitor via a switching means;

an airtight container disposed in said primary coil;

an opening defined at a predetermined portion of said airtight container; and a flying body intimately loaded into said opening of said airtight container;

wherein a high electric charge stored in said capacitor is momentarily applied to said primary coil so as to compress abruptly said airtight container radially inward and to shoot outward said flying body loaded in said opening of said airtight container.

6. An apparatus according to claim 5 further comprising a guide means extending from said opening for guiding said flying body.

* * * * *